United States Patent [19]

Kawada et al.

[11] 4,190,789

[45] Feb. 26, 1980

[54] DRIVING SYSTEM FOR A SELF-SHIFT TYPE GAS DISCHARGE PANEL

[75] Inventors: Toyoshi Kawada; Hisashi Yamaguchi, both of Kobe; Hirofumi Kashiwara, Kasai, all of Japan

[73] Assignee: Fujitsu Limited, Japan

[21] Appl. No.: 906,342

[22] Filed: May 16, 1978

[30] Foreign Application Priority Data

May 17, 1977 [JP] Japan ..... 52-57210
May 19, 1977 [JP] Japan ..... 52-57989

[51] Int. Cl.[2] ..... H05B 37/00; H05B 39/00; H05B 41/00

[52] U.S. Cl. ..... 315/169.4; 313/204

[58] Field of Search ..... 315/169.1, 169.2, 169.4; 340/759, 769; 313/204

[56] References Cited

U.S. PATENT DOCUMENTS 4,132,924 1/1979 Yamaguchi et al. ..... 315/169.2
4,147,960 4/1979 Andoh et al. ..... 315/169.4

*Primary Examiner*—Paul L. Gensler

*Assistant Examiner*—Robert E. Wise

*Attorney, Agent, or Firm*—Staas & Halsey

[57] ABSTRACT

An improved row selecting and driving system for a self-shift type gas discharge panel for providing a multi-row display in a plurality of shift rows. The shift row is composed of at least one shift channel having a regular arrangement of a plurality of discharge cells, each said discharge cell comprising opposing electrode groups of 2×2 or more phases. A shift voltage is sequentially applied to the electrode groups of a selected shift row for shifting discharge spots in that row in one direction. At the same time, a shift voltage having a different sequence of voltages from that for said selected shift row is applied to the electrode group of the non-selected shifting rows, in a sway shift operation performed within a predetermined spatial period of the cell arrangement to hold said discharge spot in said cell arrangement period. The driving system can equalize the operation margin in all of the selected and non-selected shift rows, and as a result, display quality can be improved.

23 Claims, 12 Drawing Figures

DRIVING SYSTEM FOR A SELF-SHIFT TYPE GAS DISCHARGE PANEL

BACKGROUND OF THE INVENTION

1. Field of the Invention

This invention relates to a driving system for a self-shift type gas discharge panel for multi-row display, and specifically to a new driving system which allows shift operation of a selected row independently of other non-selected rows.

2. Description of the Prior Art

A self-shift type gas discharge panel providing a discharge spot shifting function has been developed for simplifying the driving circuit of the matrix display AC driven gas discharge panel, and is basically composed of shift channels defined by a regular arrangement of a plurality of discharge cells. Various kinds of such panels have been proposed. For example, the U.S. Pat. No. 3,944,875 by Owaki et al assigned to the assignee of the present invention discloses a typical self-shift panel providing the matrix electrode structure. In addition, the U.S. Patent Applications Ser. No. 813,627 and No. 810,747 by Yoshikawa et al, also assigned to the assignee of the present invention, both disclose an improved type of self-shift panel providing a meander electrode arrangement and a meander channel structure.

In order to attain multi-row display in this type of self-shift gas discharge panel, independent shift operation is required for each row. Namely, while writing is newly performed or rewriting is executed in the selected shift row, data in the remaining non-selected shift row must be held at a specified position.

A general method of such selective shift operation for multi-row display is described, for example, in "Self-Shift Character Display" in the FUJITSU Scientific and Technical Journal, Vol. 11, No. 2. pp. 81–98, June 1975. According to this disclosure, in the existing method, each Y electrode group defining each shift row of a panel of the matrix electrode structure is individually led out, and a shift voltage is applied to the Y electrodes of the non-selected row at a certain phase timing for holding the existing data. This method has the disadvantage that a difference is generated between the operation margins of the selected and non-selected shift rows, since the discharge mode in the panel is different in the selective shift operation from in the discharge mode of the non-selective holding or display operation in the other shift rows. This results in various problems, such as data being destroyed, or mis-firing occurring at the time of transfering between these two operations. Also a difference in the brightness of the discharge spots results in transfering between the selective shift operation and the display operation, which may be unpleasant to the operator viewing the display.

SUMMARY OF THE INVENTION

The present invention offers an improved row selecting and driving system for a multi-row self-shift type gas discharge panel, eiminating the disadvantages of the abovementioned conventional systems.

In more detail, one of the objects of this invention is a row selecting and driving system which can drive with equal operation margin the selected and non-selected rows of a multi-row self-shift type gas discharge panel.

Another object of this invention in an improved row selecting and driving system which can hold the data at specified positions in the non-selected rows with a high brightness while the shift operation is being performed at the selected rows.

Another object of this invention is to offer a novel driving system in the self-shift type gas discharge panel for multi-row display, wherein a difference in brightness or flickering is eliminated during transfer of operation between the row selection and display operations, thereby improving the quality of the display.

A further object of this invention is a simple and low cost row selection and write driving system for the multi-row self-shift type gas discharge panel.

A further object is an improved writing and shift driving circuit for row selection in the multi-row self-shift type gas discharge panel providing the meander electrode structure.

Briefly speaking, this invention is first characterized by a multi-row selecting and driving system which can keep the data in non-selected rows at a specified position by means of a reciprocal or swaying shift operation, while the shift operation is being performed at the selected rows. Namely, the driving system in accordance with the first characteristic of the present invention repeats the forward shift operation and the reverse shift operation within a predetermined spatial period in the discharge cell arrangement in each of the non-selected shift rows, while the discharge spots are shifted in one direction in each of the selected rows in the form of discharge spots within said arrangement period by means of such reciprocal shift operation. This repetition of the abovementioned forward and reverse shift operation is called a "sway shift" in the following explanation.

The driving system in accordance with the second characteristic of the present invention, after the selective shift and sway operation described above as the first characteristic, sways the discharge spots in all of the shift rows within the predetermined spatial period of the cell arrangement by means of said sway shift operation to perform the display operation.

According to the third characteristic of the present invention, a write driver is used for the write electrodes, which are led out individually for each row, for writing in the corresponding position of each row by utilizing the selective shift and sway operations described above under the first characteristic.

Other objects and characteristics of this invention are made obvious from the description of the preferred embodiments in reference to the drawings.

DESCRIPTION OF THE PREFERRED EMBODIMENTS

Although the driving system of this invention is not limited only to the meander electrode arrangement, it accommodates itself well to a self-shift type gas discharge panel of this type. Therefore, prior to explaining the new driving system, this self-shift panel sturcture to which this invention may be applied will be explained.

Figure 1:
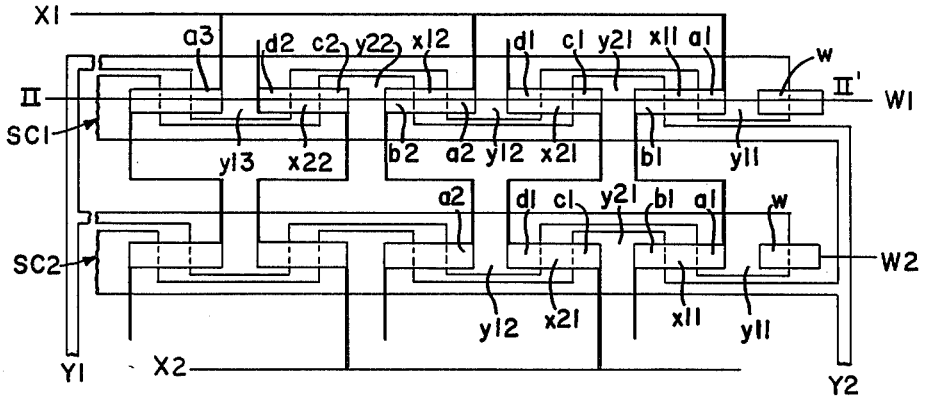
FIG. 1. (PRIOR ART)
FIG. 1 shows an electrode arrangement of the prior art self-shift type gas discharge panel having the meander electrode structure.
Figure 2:
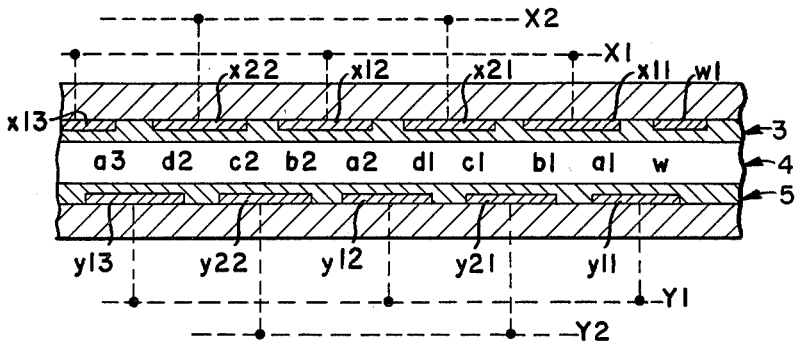
FIG. 2. (PRIOR ART)
FIG. 2 shows a cross-sectional view along the line II-II' in FIG. 1.

FIGS. 1 and 2 indicate, respectively, in plan view and in cross section along the line II—II', the electrode arrangement of the meander electrode type gas discharge panel proposed in the previously cited U.S. patent application Ser. No. 813,627 by Yoshikawa et al., and two typical shift channels SC1 and SC2 are indicated. This gas discharge panel provides on one substrate 1 a first electrode group x11, x12 . . . xlj (where j is a positive integer) and a second electrode group x21, x22 . . . x2j, which are alternately connected to a pair of bus conductors x1 and x2, and the write electrode W. On the other substrate 2 a third electrode group y11, y12 . . . y1j and a fourth electrode group y21, 622 . . . y2j are arranged alternately and in opposition to an adjacent electrode pair of said first and second electrode groups, and connected alternately to a pair of bus conductors Y1 and Y2. The surface of each electrode is coated with a dielectric layer 3 or 4 of alumina or low melting point glass etc. and the gap 5 between these electrodes is filled with a mixed gas of neon (Ne) and a little xenon (Xe) to have a p.d. value (gas pressure times gap spacing) of 4 to 5 Torr-cm. Thus, in said gas-filled gap 5, the 4-phase discharge cells ai, bi, ci and di (i=1,2 . . . ), corresponding to the combination of opposing areas of electrodes of each of the four groups of electrodes, are regularly arranged and the abovementioned shift channels SC1 and SC2 are formed by this arrangement of these discharge cells. When the pulse voltages for each of the bus conductors X1, X2 and Y1, Y2 are applied alternately and in succession, the discharge spots generated at the write-in discharge cell w positioned at the end of each shift channel, in accordance with input data to the write electrode, can be sequentially shifted to the adjacent discharge cell.

Figure 3:
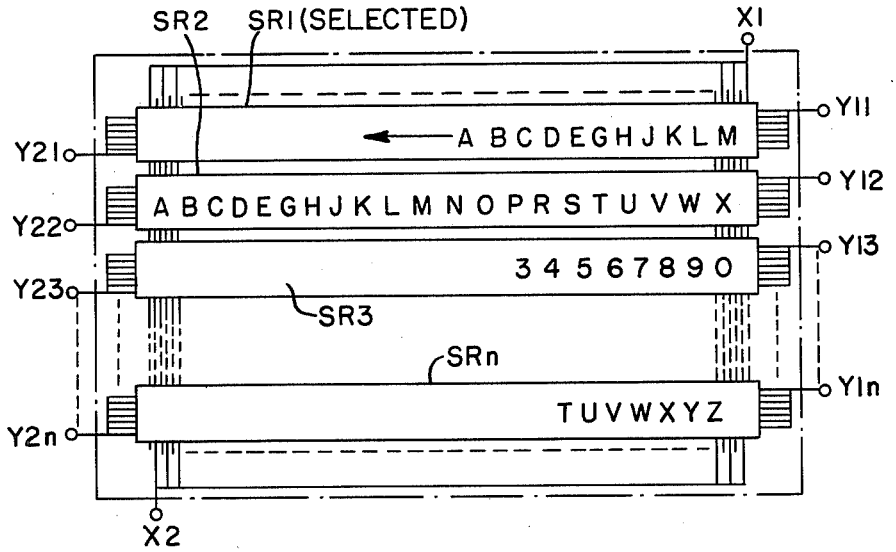
FIG. 3 is a plan view schematically showing a display example in a panel of the multi-row structure shown in FIGS. 1 and 2.

The self-shift type panel having this meander electrode structure does not by itself represent the present invention, which has various other advantages for attaining multi-row display operation in addition to the merits of high resolution, high reliability and high display quality. Therefore, in a preferred embodiment of the present invention, a self-shift type gas discharge panel for multirow display having a plurality of rows of shift channels, defined between opposing portions of adjacent discharge cells, are arranged in a regular repetitive order as shown, with each opposing electrode being in common to two adjacent discharge cells. FIG. 3 shows an example of a panel for multi-row display in which pluralities of shift channels as typically explained above with reference to FIG. 1 are arranged in the same panel to form a plurality of shift rows, SR1, SR2 . . . SRn. In this case, each shift row consists of seven (7) shift channels, thereby displaying character data with a 5×7 dot pattern. In order to realize the shift operation for the discharge spots in each row, the two (2) Y electrode groups for each shift row, corresponding to two (2) kinds of terminals indicated by Y11, Y12 . . . Y1n and Y21, Y22 . . . Y2n are individually led out. In addition, the abovementioned two (2) X electrode groups, which are in common to all the shift rows, are respectively led out to the terminals indicated by X1 and X2.

The present invention has the feature that the data in the remaining non-selected shift rows is maintained for display by means of a sway shift operation while at the same time the write operation and the subsequent shift operation are performed in selected shift rows.

Figure 4:
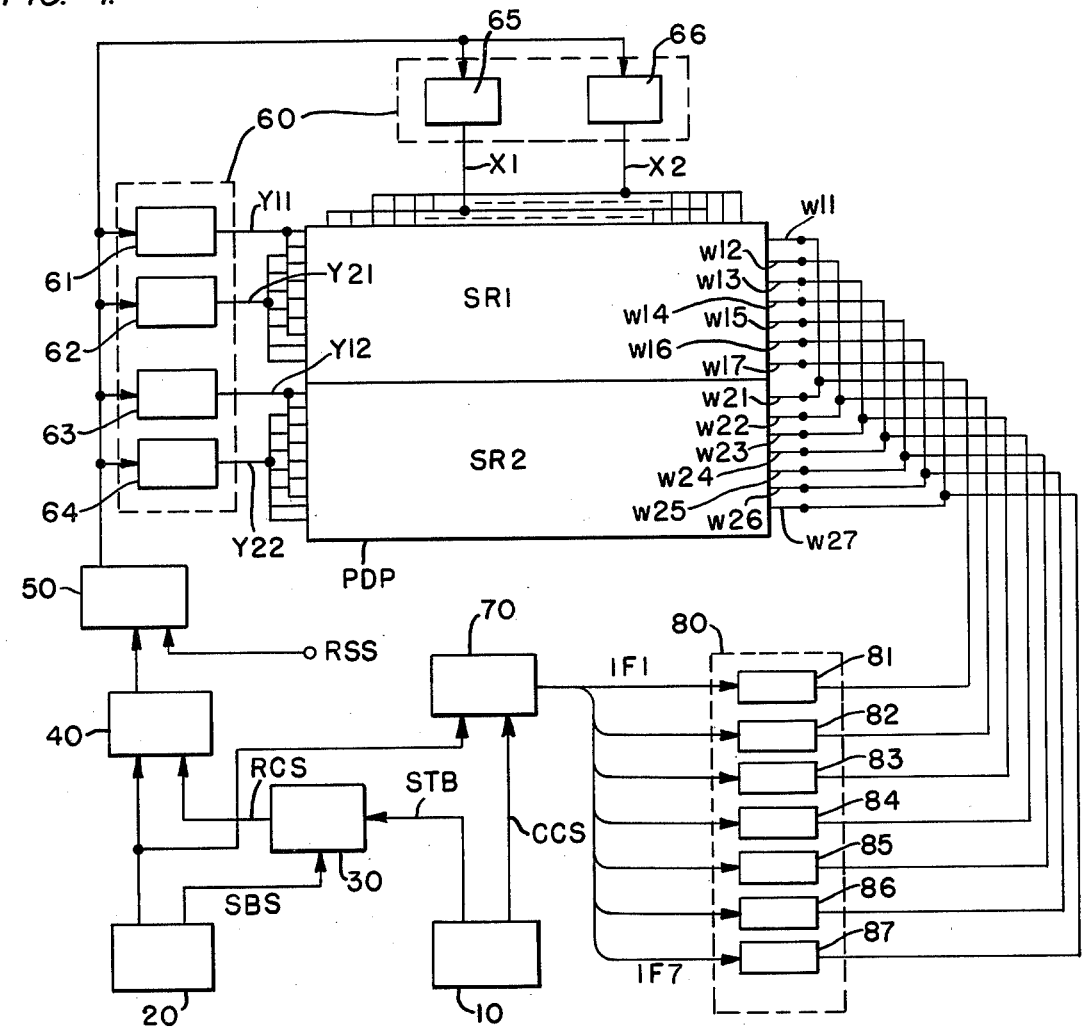
FIG. 4 is a block diagram showing an embodiment of the driving system for the self-shift type gas discharge panel in accordance with the present invention.

FIG. 4 shows schematically a block diagram of a driving system as an embodiment of the present invention. This includes the keyboard 10, a basic timing signal generator circuit 20, a control signal generator circuit 30, a rotation circuit 40, a row selection circuit 50, a shift drive circuit 60, a write signal generator circuit 70 and a write driving circuit 80. In this embodiment, the meander electrode type panel described above may be used as the multi-row display self-shift type gas discharge panel, to supply the indicated two (2) shift rows SR1 and SR2. The keyboard 10 respectively generates the character code data signal CCS corresponding to the character data to be written and the strobe signal STB which issues the write command in response to the operator's keyed instructions. The basic timing signal generator circuit 20 generates respectively four (4) basic pulse trains, corresponding to four basic timing signals used for both the shift operation and the write operation, and the standard signal SBS for keeping track of the number of shift operations. The control signal generator circuit 30 generates the rotation change-over signal RCS in order to realize the shift operation for each character in accordance with character data being input in response to said strobe signal STB and said standard signal SBS. Since the meander electrode type panel of this embodiment has the 4-group and 4-phase discharge cells periodically arranged, rotation of the shift operation forms a cycle with 4 unit periods. Further, if this embodiment has a character pattern of 5×7 dots, a pattern of one character can be written by five (5) rotations for seven (7) shift channels. If a space of two dots is allowed between characters, then the 8th rotation provides the write timing of the next character. Therefore, said rotation change-over signal RCS controls the entry of each new character.

The rotation circuit 40 sequentially rotates the basic timing signals for distribution respectively to two electrode terminals in each the Y and X sides, in accordance with said rotation change-over signal.

The row selection circuit 50 is shown, in the case of FIG. 4, as having a selection function for 2 shift rows and provides for selectively outputting the basic timing signals in a predetermined distribution sequence so that the shift operation and sway shift operation are respectively performed in the selected and non-selected shift rows with response to the row designation signal RSS.

The shift drive circuit 60 has six (6) drivers 61 to 66 which are respectively connected to the Y side electrode terminals Y11, Y21, Y22, Y12 and X side electrode terminals X1, X2 of panel PDP, and these drivers generate the shift voltage pulse SP in response to said basic timing signals. The write signal generator circuit 70 generates the 5×7 dot pattern signals IF1 to IF7 in sequential response to the character code data signal CCS as 7 dots for each cycle of 4 unit period corresponding to the four basic timing signals. The write driving circuit 80 includes seven (7) drivers 81 and 87 which are mutually connected in common as shown in FIG. 4 to said two write electrode groups W1i and W2i, and these drivers generate write voltage pulses Wp in response to said character pattern signals.

If, for example, in the above embodiment, the first shift row SR1 is selected in accordance with the row designation signal RSS when character data is keyed in from the keyboard 10, then the following operations are performed. The control signal generator circuit 30 is driven by the strobe signal STB sent from the keyboard 10 and generates a rotation change-over signal RCS. The rotation circuit 40 receives this rotation change-over signal and controls the distribution sequence of the timing signals sent from the basic timing signal generator circuit 20. The row selection circuit 50 applies the timing signal in the specified distribution sequence to the shift drivers in the X and Y sides corresponding to the selected first shift row SR1 so that the ordinary shift operation can be executed in accordance with said row designation signal. However, at the time of this shifting operation it applies in a different distribution sequence the timing signals to the corresponding drivers of the non-selected second shift rows SR2, namely in the distribution sequence for the sway shift operation. The character code data signal CCS output from the keyboard 10 is converted into the character pattern signals IF1 to IF7 via the write signal generator circuit 70. Each driver 81 to 87 of the write driving circuit 80 is selectively driven by this pattern signal, applying the write pulse to the corresponding write electrodes W1i, W2i on the panel PDP. As a result, the character data is sequentially input by generating a discharge spot at the write discharge cell at the end of each shift row. Each discharge spot thus written in the selected first shift row SR1 is sequentially shifted to the left side of the panel in accordance with the previously described shift operation mode. However, in the non-selected second shift row SR2, the simultaneously written discharge spot is automatically eliminated as a result of the sway shift. Therefore, even though each write electrode group of each shift row is respectively connected in common to the write driving circuit, as shown in FIG. 4, entry of data by writing a discharge spot into a non-selected row is of no effect. This is because data in the second shift row is only being sway shifted, and only such previously written discharge spots are maintained by the sway shift operation.

Figures 5, 6, 7, 8:
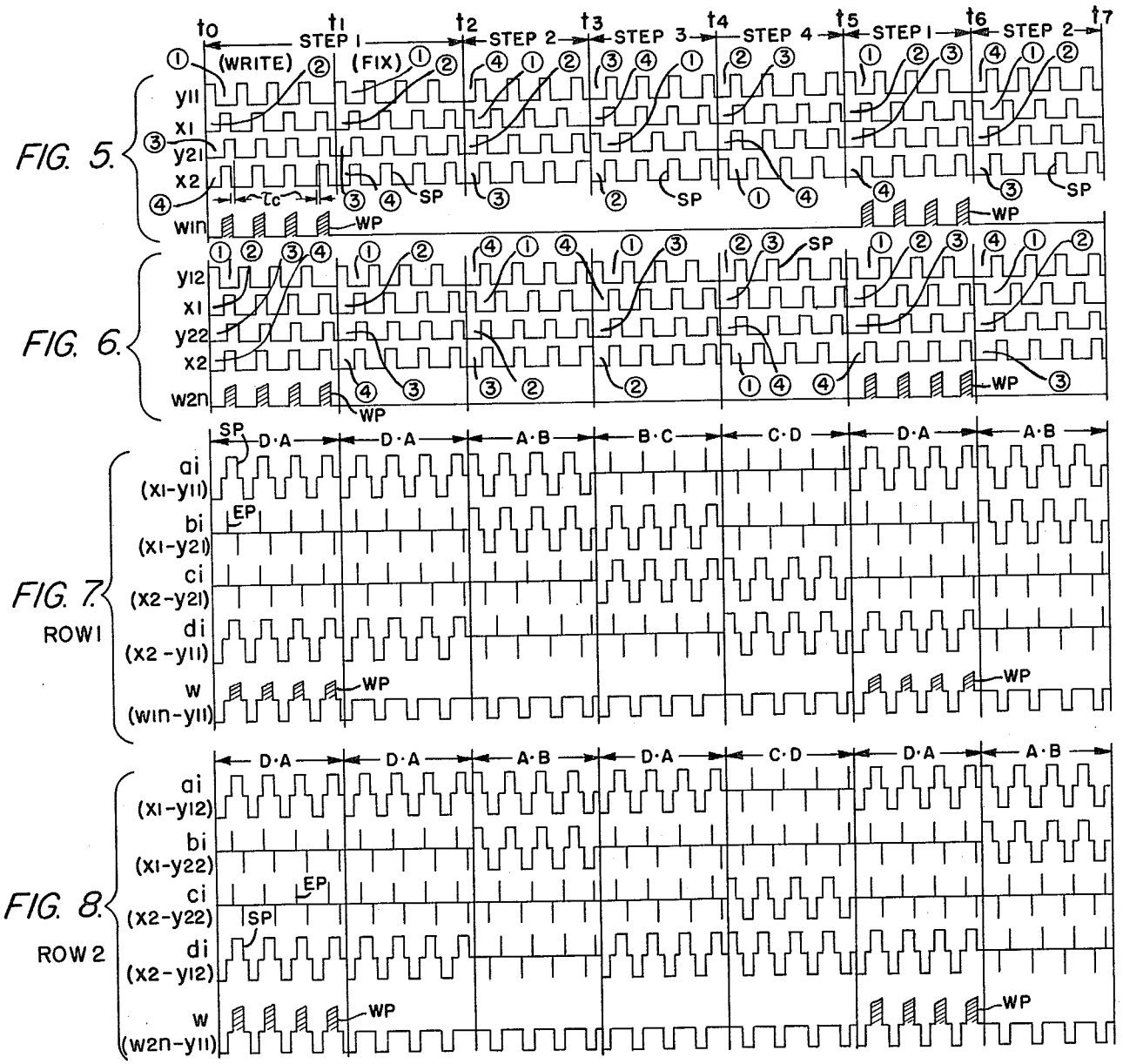
FIGS. 5 and 7, respectively, show an example of driving waveforms for the selected shift rows.
FIGS. 6 and 8, respectively, show an example of driving waveforms for the non-selected shift rows.

As described above, the keyed in character data is sequentially written in accordance with the shift operation at the selected first shift row, but at the non-selected second shift row, the already written character data is maintained during this period by means of the sway shift operation. Hereunder, such shift operation and sway shift operation will be described in more detail. Namely, FIGS. 5 to 8 show driving voltage waveforms for attaining such shift operation and sway shift operation for a plurality of shift rows, in the case above for the selected first shift row SR1 and the non-selected second shift row SR2. FIGS. 5 and 6, respectively, show the electrode voltage waveforms to be applied to each electrode of the selected first shift row, and of the non-selected second shift row, via the indicated bus conductor terminals, and FIGS. 7 and 8, respectively, show the resulting voltage waveforms applied across the discharge cell groups between indicated electrodes of said first and second shift rows. As is apparent from these figures, the shift operation of the meander type gas discharge panel is performed by distributing four basic pulse trains ①, ②, ③ and ④, respectively corresponding to four basic timing signals, to the respective pluralities of bus conductor terminals in the proper sequentially rotating relation. The write operation is executed in the unit period where the discharge cells of phase D and phase A are activated by the shift voltage pulse SP, in the basic cycle comprising four unit periods.

For example, if the write operation is applied to each shift row during the unit period from $t_0$ to $t_1$, the write voltage pulse WP is simultaneously applied to each electrode terminal W1n and W2n. In other words, the out-of-phase shift voltage pulses are applied to the first Y electrode y11 and to the X electrode x11 opposing the write electrode W via the bus conductor terminals Y11, Y12 and X1, and thereby the write timing occurs when the discharge cells of the D and A (henceforth D.A) phases are activated. Therefore, during the period from $t_0$ to $t_1$, the discharge spots appear at the adjacent two discharge cells w and ai in accordance with input data. At this time, when a discharge spot exists already at the discharge cells groups ci.di of the C.D phase in each row, this discharge spot is shifted to the adjacent discharge cell group di and ai of the D.A phase. On the other hand, the operation mode in this writing period is the same as the fix mode for display, and when this display mode is required, the period of $t_1$ to $t_2$ is prolonged. Namely, the common shift voltage pulse SP is applied to the Y electrode terminals Y11 and Y12 of each shift row, while the shift voltage pulse of opposite phase is applied to two X electrode terminals X1 and X2. Moreover, to the other Y electrode terminals Y21 and Y22 of each row, a shift voltage pulse is applied with a phase difference $\tau_e$ corresponding to the time slot of the erase pulse formed by the combined waveforms applied to opposing electrodes at the rising and falling edges of the shift voltage pulses of said X electrode terminals. Thereby, shift voltage pulse trains are applied to adjacent discharge cell groups di and ai of the D and A phases between the one Y electrode y1i of each shift row and X electrodes x1j, x2j which are commonly opposing said Y electrode y1i, while such a narrow erase pulse EP as shown in FIGS. 6 and 8 is applied effectively due to said phase difference to the discharge cell groups bi and ci of the B and C phases having the other Y electrode y21 in common. Therefore, the character data previously written in each row is maintained during the period from $t_1$ to $t_2$ in the form of commonly having all discharge spots in the phases D and A of the adjacent two discharge cells di and ai, and thereby the fix mode display of characters is performed.

For completing the shift operation in the selected first shift row SR1, the shift voltage pulses applied via each bus conductor are sequentially switched in each of the four unit periods to the four electrode groups defining the seven shift channels of the selected first shift row in the order $t_2$–$t_3$, $t_3$–$t_4$, $t_4$–$t_5$, . . . as shown in FIG. 5. In other words, the four basic pulse trains respectively designated by ①, ②, ③, and ④ are distributed with sequential rotation to each electrode group, and the four phases A.B, B.C, C.D, D.A of two adjacent discharge cells as shown in FIG. 6 are sequentially activated and thus selective shift operation of the discharge spot is carried out.

Figure 9:
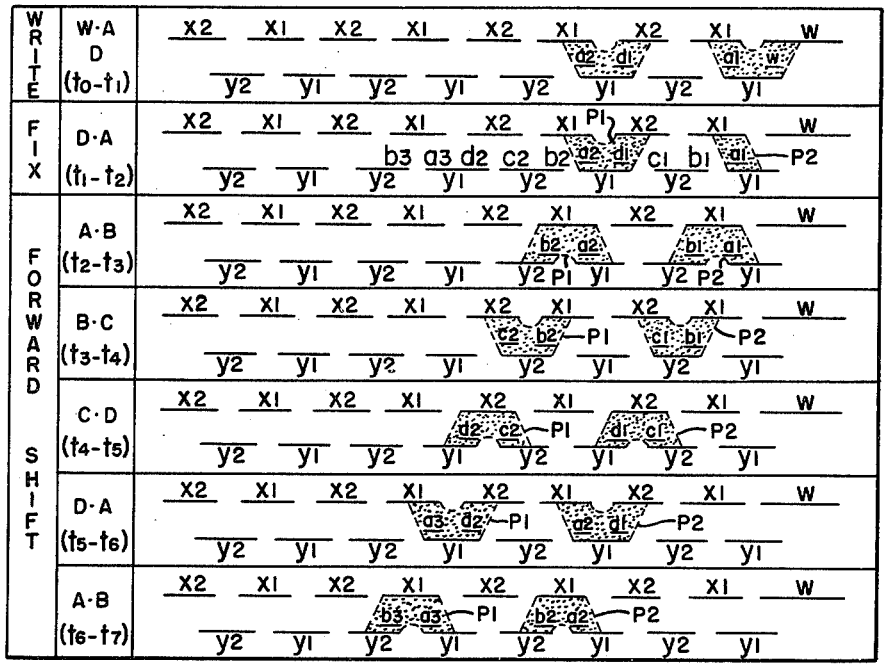
FIGS. 9 and 10, respectively, show the modes for shifting discharge spots in the selected and non-selected shift rows.

FIG. 9 schematically shows in profile the shift operation of the discharge spot in one shift channel of the selected first shift row SR1 in correspondence with the cell voltage waveforms shown in FIGS. 5 and 7. In this figure, the discharge spot written previously is indicated as P1 and the newly written discharge spot as P2. As is clear from this figure, the discharge spot P1 being fixed at the adjacent discharge cells d1.a2 is shifted as shown along adjacent pairs of cells in the sequence of a2.b2→b2.c2→c2.d2→d2.a3→a.3.b3 in accordance with the switching of the shift voltage pulses. Moreover, the discharge spot P2 generated at the adjacent discharge cells w and a1 in accordance with the input data is simultaneously shifted in the sequence of a1.b1→b1.c1→c1.d1→d1.a2→a2.b2 in accordance with the switching of the shift voltage pulses. On the other hand, while this shift operation is carried out in the selected shift row SR1, the sway shift operation which is a characteristic of the present invention is performed in the non-selected shift row SR2.

Namely, the two X electrode groups in common to all shift channels of the non-selected shift row SR2 are also in common to the terminals X1 and X2 of the X electrode group of the selected shift row SR1. Therefore, the pulse train for each step is applied to these X electrode groups in the same relation as in the case of the selected shift row. On the other hand, however, to the two Y electrode groups of the non-selected shift row, the pulse train for each step is applied via the terminals Y12 and Y22 in common to each row in a respective sequence that is different from that for the Y electrode groups of the selected shift row. As a result of the electrode voltages shown in FIG. 6 and the resulting cell voltages shown in FIG. 8 as applied to the non-selected shift row, the basic sway shift period has four repetitions of the voltage pulses within each of four unit periods. The application sequence of the shift voltage pulse trains ① and ③ for the Y electrode group in the third step of the basic sway shift period in the non-selected shift row is interchanged with that in the selected shift row.

Therefore, in the forward shift operation of the second step $t_2$–$t_3$ of the basic shift period, following the fix condition of $t_1$–$t_2$, the forward shift is carried out in both the selected and non-selected shift rows; however, during the third step $t_3$–$t_4$, while the discharge spot is shifted forward in the selected shift row SR1 from the adjacent cells ai.bi of the phase A.B to the adjacent cells bi.ci of the phase B.C, at the non-selected shift row SR2, each discharge spot is returned again to the cells di.ai of phase D.A from the cells of the phases A.B, since a shift voltage pulse ① which is in opposite phase to the pulse trains ④ and ② of the X electrode group side is applied only to the one Y electrode terminal Y12 (during this period, at the selected shift row, the pulse train ① with the reversed phase is applied only to the Y electrode terminal Y21). in the next fourth step, $t_4$–$t_5$, the cells in the D.C. phase are activated as in the case of the selected shift row, but the discharge spots are shifted in the backward direction to the adjacent cells di.ci of the D.C phase from the cells in the D.A phase. Thereby, the write discharge spot P2 generated at the selected row with the write operation is eliminated since the erase pulse EP is applied to the relevant cell a1 at this timing. Therefore, at the non-selected shift row, the already written data is maintained but the data written simultaneously with that written in the selected shift rows is automatically eliminated, thus effectively realizing writing of data only into the selected shift rows.

Figure 10:
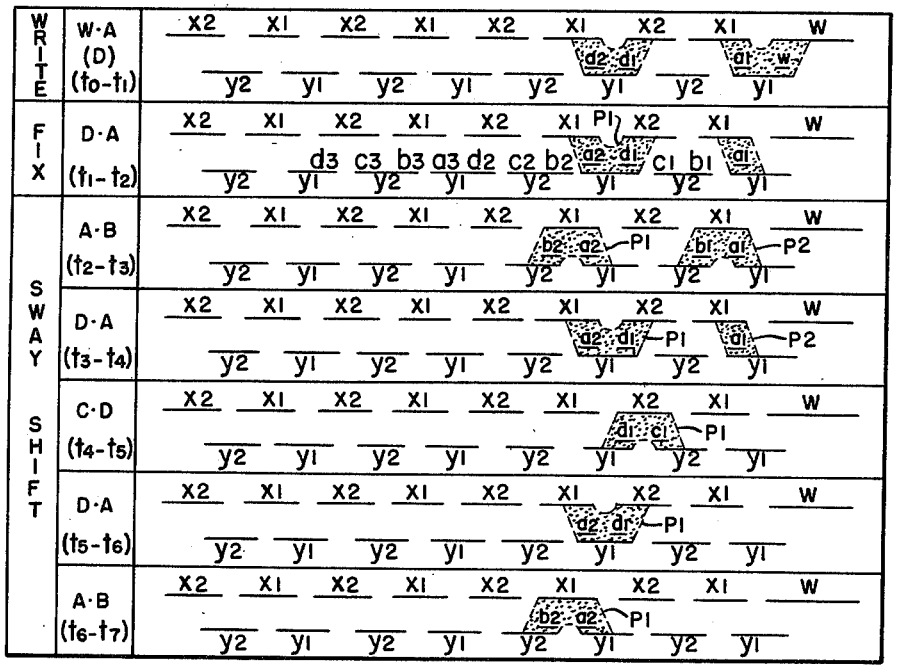

FIG. 10 shows schematically the sway shift operation at the non-selected shift row SR2. As in the case of FIG. 9, the already written discharge spot is considered as P1, and the newly written discharge spot as P2. As is clear from this figure, when the already written discharge spot P1 is shifted backwards to the discharge cells d1.c1 of the D.C phase at the fourth step ($t_4$–$t_5$), the already written discharge spot P1 in the selected shift row SR1 is shifted forward to the cells d2.c2 of the same phase which are spatially separated by one period of the discharge cell arrangement. In the next step $t_5$–$t_6$, the first of the second basic period, since the shift voltage pulses in the same relation are applied to both the non-selected and selected shift rows, the discharge spots in the non-selected shift rows are shifted in the forward direction to the cells of the D.A phase from the cells of the C.D phase, returning to the initial position at the time of fixing display. Thereafter, the shift operations in the forward and reverse direction are repeated by the same steps, and thus the discharge spot P1 at the non-selected shift row SR2 is maintained while vibrating within the spatial cell arrangement period of 4 groups and 4 phases. On the other hand, the newly written discharge spot P2 is returned to the initial position in the previous writing time at the third step ($t_3$–$t_4$). However, at this time, the write voltage pulse is not applied to the write electrode W and therefore a discharge spot is not generated at the write discharge cell w and discharge is generated only at the discharge cell a1.

In the next fourth step ($t_4$–$t_5$), the relevant cells are activated so that the discharge spot is shifted backward to the cells of the C.D phase. At this time, also, the write electrode is not activated as in the case of the above operation, and therefore the discharge spot P2 is eliminated perfectly.

As explained above, in the present invention, while the ordinary shift operation is performed in the forward direction at the selected shift row, the data in the non-selected shift row is maintained by the sway shift operation within the specified spatial cell arrangement period. However, when employing such a driving system, the present invention is very convenient in that the shift voltage pulse application sequence can easily be interchanged between the selected and non-selected rows in the self-shift type as discharge panel having the meander electrode structure with the cells arranged between opposing electrodes which are mutually offset or alternatively overlaping as indicated above.

Figure 11:
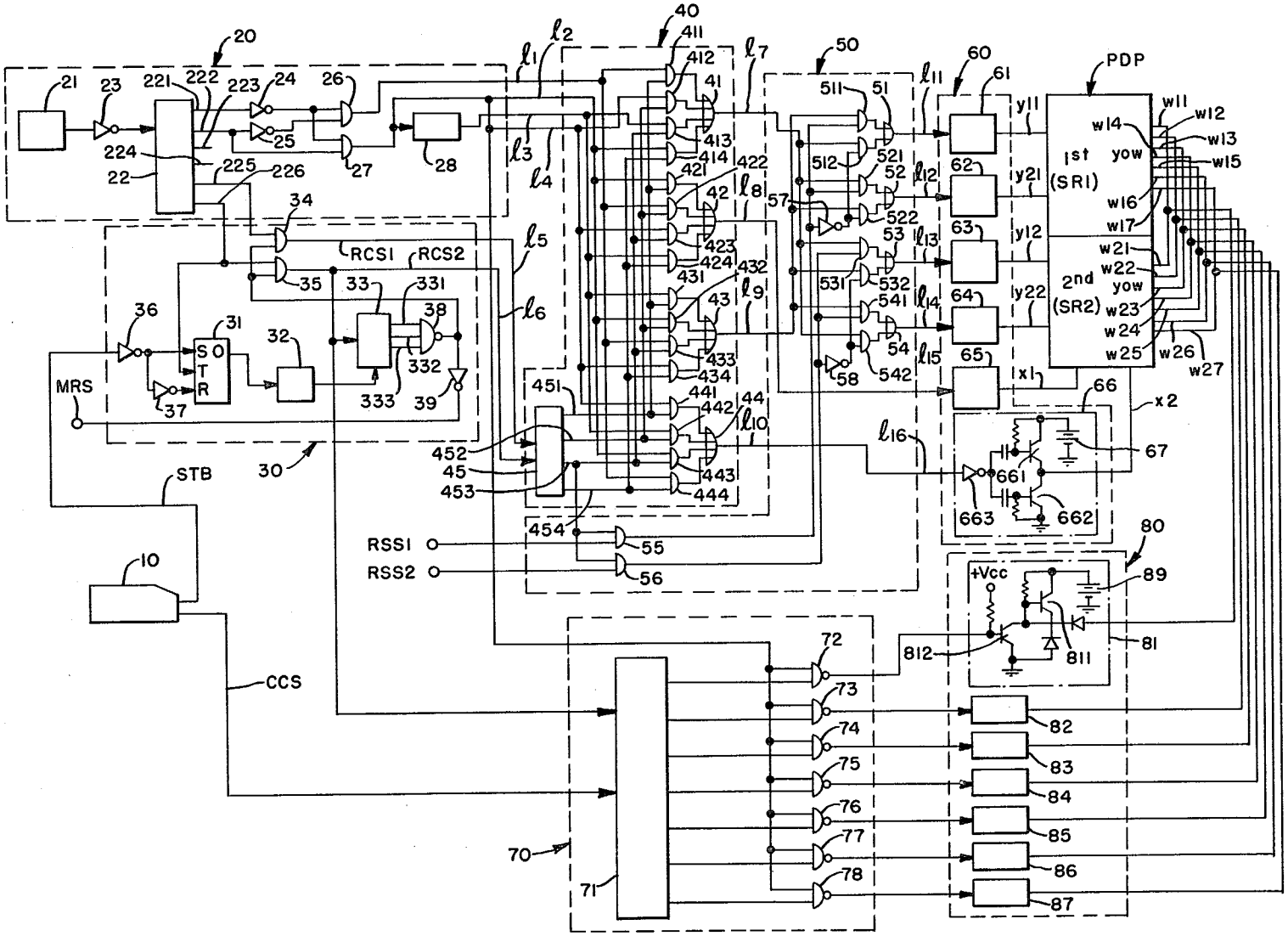
FIG. 11 shows an embodiment of the driving circuit in accordance with the present invention.

FIG. 11 shows an embodiment of the driving circuit conforming to the block diagram of FIG. 4 for attaining the abovementioned selective shift operation and non-selective sway shift operation of the gas discharge panel for multi-row display.

The basic timing signal generator circuit 20 controls the timing of generating the abovementioned four basic pulse trains ①, ②, ③ and ④, and is mainly composed of the clock pulse generator 21 and a binary counter 22. The clock pulse of the clock pulse generator 21 is applied to an input terminal of said counter 22 via the inverter 23. Said counter 22 has six output terminals 221 to 226 and generates an output of 6 bits from these terminals. The first bit and second bit outputs of said counter 22 are respectively inverted by the inverters 24 and 25 and applied to the two input terminals of the AND gate 26. The output terminal of said AND gate 26 is connected to the signal line l1 and the first timing signal corresponding to the abovementioned basic pulse train ① is supplied to this line. In addition the inverted output of the first bit and the second bit output are respectively applied to the two input terminals of the AND gate 27. The output terminals of said AND gate 27 are respectively connected to the two signal lines 12 and 14, and the second and fourth timing signals corresponding to the abovementioned basic pulse trains ② and ④ are supplied to these signal lines. The output terminal of said AND gate 27 is also connected to the input terminal of the delay circuit 28, and said delay circuit 28 applies the third timing signal corresponding to the abovementioned basic pulse train ③ which is delayed in phase from said second and fourth timing signals to the signal line 13. These timing signals are output in every 4-counting of the clock pulse.

The control signal generator circuit 30 is composed of a flip-flop circuit 31, a monostable circuit 32, a binary counter 33 and a pair of AND gates 34 and 35. Said flip-flop circuit 31 is of the R-S-T type, and the strobe signal STB sent from said keyboard 10 is applied to the set terminal S via the inverter 36. Said strobe signal corresponds to the logic level "0" and is output continuously for a period sufficient for writing one character. To the reset terminal R, on the other hand, is connected the output terminal of inverter 37 which has an input terminal connected to said inverter 36. Moreover, the sixth bit output of said counter 22 is applied to the trigger terminal T. Said sixth bit output is output in every 64-count of the clock pulse, and this generation timing corresponds to one period of said four timing signals. Therefore, it corresponds to one cycle of the shift operation. This signal also corresponds to the standard signal SBS described in FIG. 4. Said flip-flop circuit 31 generates the logic "1" level from the one output terminal Q until writing of one character comes to an end in accordance with such input relation. The monostable circuit 32 receives this logic "1" level output and generates the reset signal for the binary counter 33 when it changes to the logic "0" level signal. Said counter 33 counts the sixth bit output of said counter 22 having passed the AND gate 35 and is reset by said reset signal in every 8-count. Thus, the 3-bit output indicating this 8-count is led to three output terminals 331 to 333 and then applied to the NAND gate 38. Said NAND gate 38 generates the logic "1" level while the 8-count is performed in accordance with these inputs, opening the gate of a pair of AND gates 34 and 35. These AND gates 34 and 35 allow respectively the fifth and sixth bit output of said counter to pass while this gate is open. The two outputs of these AND gates are considered as the abovementioned rotation change-over signals RSC1 and RSC2 and then supplied to the two signal lines 15 and 16. This rotation change-over signal is continuously output until said sixth bit output is counted up to 8. Therefore, the shift operations of eight cycles are performed during this period and as a result the character data of 5×7 dots including the inter-character space of two dots can be written. And, when generation of this change-over signal stops, namely, when the output of said NAND gate 38 becomes the logic "0" level, this "0" level output is inverted by the inverter 39 and thereby becomes "1". It is generated as the signal MRS for the next character writing command.

The rotation circuit 40 comprises four groups of the AND gates 411 to 414, 421 to 424, 431 to 434 and 441 to 444 each of which is composed of four gates, OR gates 41, 42, 43 and 44. To the one input terminal of the AND gates 411, 422, 433 and 444, said signal line 11 is mutually connected. To the other input terminal of the AND gates 414, 421, 432 and 443, said signal line 12 is mutually connected. To the other input terminals of the AND gates 413, 424, 431 and 442, said signal line 13 is mutually connected. To the other input terminals of the AND gates 412, 423, 434 and 441, said signal line 14 is mutually connected. Said rotation circuit 40 is also provided with the decoder 45 for decoding said rotation change-over signals RCS1, RCS2. Said decoder 45 has four output terminals 451 to 454, and the output terminal 451 is connected respectively with the other output terminals of said AND gates 411, 421, 431 and 441. The other input terminal of said AND gates 412, 422, 432 and 442 is respectively connected to the output terminal 452. To the output terminal 453 is connected the other input terminal of said AND gates 413, 423, 433 and 443, while to the output terminals 454, the other input terminal of said AND gate 414, 424, 434 and 444 is connected respectively. Moreover, each output terminal of said OR gates 41 to 44 which receive the output of the AND gate of each pair is respectively connected to the signal lines 17 to 110, and the basic pulse train for the Y and X side electrode terminals is respectively supplied to these lines. The two selection circuit 50 shown in FIG. 11 has the selection functions of two rows. In order to change the sequence of the driving basic pulse trains for the Y electrode groups of each shift row at the time of the shift operation in the third step in accordance with the row designation signals RSS1 and RSS2, four pairs of AND gates, 511–512, 521–522, 531–532, 541–542 are inserted in said signal lines 17 and 19, and the OR gates 51, 52, 53 and 54 are connected to the output side of each pair. In other words, said signal line 17 is connected to one input terminal of the AND gates 512, 521, 531 and 542, and thereby the basic pulse trains are input to one Y electrode. Said signal line 19 is connected to the one input terminal of the AND gates 511, 522, 532, 541 and thereby the pulse trains are input to the other Y electrode side. In addition, to the other input terminals of these AND gates are connected the outputs of a pair of AND gates 55 and 56, which open the gates when the third bit output of said decoder 45 matches with the row designation signal, in such a relation as shown in the figure including the inverters 57 and 38. The principle of the basic pulse train distribution operation in accordance with the abovementioned rotation method is described in the U.S. patent application Ser. No. 21,1030 by Yamaguchi et al. assigned to the same assignee as in the case of the present invention.

When both row designation signals SSR1 and SSR2 are at the "0" logic level, the AND gates 512, 522, 532 and 542 which receive the inverted output of the inverters 57 and 58 open, and the basic signal sent from said signal line 17 appears at the output signal lines 111 and 114 of the OR gates 51 and 54, while the basic signal sent from said signal line 19 appears at the output signal lines 112 and 113 of the OR gates 52 and 53. Therefore, under such conditions, when the output of said decoder 45 is changed in every 16-count of the clock pulse corresponding to the one unit period, as a result the basic timing signal distribution sequence also changes in the relation of sequential rotation, and thereby parallel shift operation can be provided for the two shift channels of the self-shift type gas discharge panel PDP.

On the other hand, when the row designation signal SRS1 is set to the logic "1" level in order to attain the selective shift operation of the first row, at the third step of the one rotation period, namely, at the timing where the third bit output of said decoder 45 becomes the logic "1" level, the signal on the signal lines l14 and l13 connected to the Y electrode terminals Y12 and Y22 of the second shift row is changed to the signal through the other AND gates 531 and 541, and as a result, the signal which is interchanged by the basic signal to the Y electrode terminals Y11 and Y21 of the first shift row is supplied to the Y electrode terminal of the second shift row. Thus, as explained in FIG. 5 to FIG. 8, at the selected first shift row, the ordinary forward shift operation is carried out by means of the driving voltage pulse trains as shown in FIG. 5 which are supplied via the Y side drivers 61, 62 and in the X side by the common drivers 65 and 66 comprising the shift driver circuit 60 described below, while at the non-selected second shift row, the driving voltage pulse trains as shown in FIG. 6 are supplied via the Y side drivers 63, 64 and common drivers 65 and 66 in the X side and the data is maintained by means of the sway shift operation.

On the other hand, when the row designation signal SRS2 is set to the logic level "1" in order to attain the selective shift operation of the second row, the signals of the signal lines l11 and l12 connected to the Y electrode terminal of the first shift row are interchanged at the third step in the same way, and thus the selective shift operation is performed at the second shift row, while the sway shift operation at the first shift row proceeds in the same relation as described above.

In the circuit configuration shown in FIG. 11, the shift drive circuit 60 comprises six (6) drivers 61 to 66 which are respectively inserted between said signal lines l11 to l16 and said electrode terminals Y11, Y21, Y22, Y12, X1 and X2, and these drivers, as shown in detail in 66, have a pair of transistors 661, 662 as the shift pulser connected in series between the shift power source of +Vs 67 and ground and the inverter 663 which inverts an input pulse and provides the shift voltage pulse SP from the center of the transistors by being driven alternately with each of said 4-phase timing signal pulse trains.

On the other hand, the write signal generator circuit 70 comprises a character generator 71 and seven (7) NAND gates 72 to 78. Said character generator 71 receives the character code data signal CCS from said keyboard 10 and the sixth bit output of said counter 22 corresponding to the rotation change-over signal RCS2, and it also outputs sequentially the character pattern signal IF 1 to IF 7 of 5×7 dots selected in a unit of as many as 7 dots in every 4 unit period in accordance with these signals. Said NAND gates 72 to 78 selectively output these pattern signals in accordance with said basic pulse train ② (or ④) being input to the other input terminal and then apply it to the write drive circuit 80. The write drive circuit 80 is provided with seven (7) drivers 81 to 87 connected respectively to said NAND gates 72 to 78, and each driver, as shown in detail for 81, provides a pair of transistors 811 and 812 as the write pulser connected between the write power source 89 of +Vw and the earth, and when the transistor 811 becomes OFF and transistor 812 becomes ON due to said character pattern signal, this circuit outputs the write voltage pulse WP from the collector of said transistor 812. These pulses are mutually applied in common to seven (7) write electrodes W1n, W2n of each shift row in said panel PDP. Thus, the data corresponding to the character pattern is sequentially written in the seven shift channels of the selected row, and the discharge spot generated thereby is sequentially shifted in common to adjacent pairs of discharge cells by means of said rotation operation.

One embodiment of this invention has been explained above, but the subject matter of this invention is not limited only to this embodiment, since the present invention can be expanded and modified in various applications as desired.

For example, in the circuit configuration above of FIG. 11, in order to perform the display operation by fixing the discharge spot of each row after completion of the specified write and shift operation, it is only required to keep the counter 33 of the control signal generating circuit 30 at the full count condition (reset when the write strobe signal STB is stopped) and the AND gates 34 and 35 are closed by the output of the NAND gate 38. As a result, only the discharge cells in the D.A phase as shown in the period $t_1$–$t_2$ of FIG. 5 to FIG. 8 are continuously activated, and fixed display is performed in the two adjacent cells of di.ai. However, this fixed display mode is different from one period of the sway shift mode between four discharge cells in the abovementioned non-selected shift row. Therefore, when the operation mode is switched to the fix operation from the multi-row selective shift operation, the discharge picture element size is substantially different in the non-selective row where the discharge spot has been maintained by means of the sway shift operation, and therefore difference of brightness and flickering occur, which in some cases which give a singular feeling to the operator.

According to modification of this invention, it is proposed to employ the sway shift mode also in the display operation in view of eliminating difference of brightness while in the abovementioned sway shift and fixed display modes. Namely, in the configuration of FIG. 11, when the rotation change-over signals RSC1 and RSC2 sent from the control signal generator circuit 30 are used effectively and all of the row designation signals SRS1 and SRS2 are placed at the logic level "1", the distribution relation of the basic pulse trains for the Y electrode terminals in the third step is interchanged with that at the time of the forward shift operation and therefore the sway shift operation can be made for all shift rows. Therefore, by employing the display mode by means of such sway shift operation, the sway shift is continuously performed for the non-selected rows during transfer to the display operation and for this reason the abovementioned difference in the brightness and flickering can be eliminated and, moreover, it becomes possible to give satisfactory display with small space between the adjacent picture elements since the data can be displayed as the substantially larger picture element.

In the above embodiment a method is explained where the basic pulse trains having the same pulse width as shown in FIG. 5 to FIG. 8 are prepared with different phase, and adjacent pairs of cells are simultaneously activated by means of mutual phase difference and the erase pulse is effectively given to the remaining two cells. This method is extremely preferential as compared with the singly activated discharge cell self-shift system which uses the individual narrow erase pulse and the overlap pulse for the shift operation for simplifying the driving circuit and for ease of control. However, the subject matter of this invention is not limited to such differences between driving systems, and the invention can be adapted to the singly activated discharge cell self-shift system in the same way.

Moreover, this invention is suitable for the self-shift type gas discharge panel having the meander type electrode structure, and in addition, it can also be adapted to the multirow display panel providing the meander type shift channel. This panel is described in the specification of the U.S. Pat. No. 810,747 assigned to the same assignee as in the case of this invention. In addition to these, the present invention can be applied to other panels having various configurations, such as those having electrode structures where the number of electrode groups is increased beyond 2×2 groups, and also to such as those having parallel electrode structures, or those providing matrix type electrode structures, etc.

Other modifications of this invention include, but are not limited by, the following.

Figure 12:
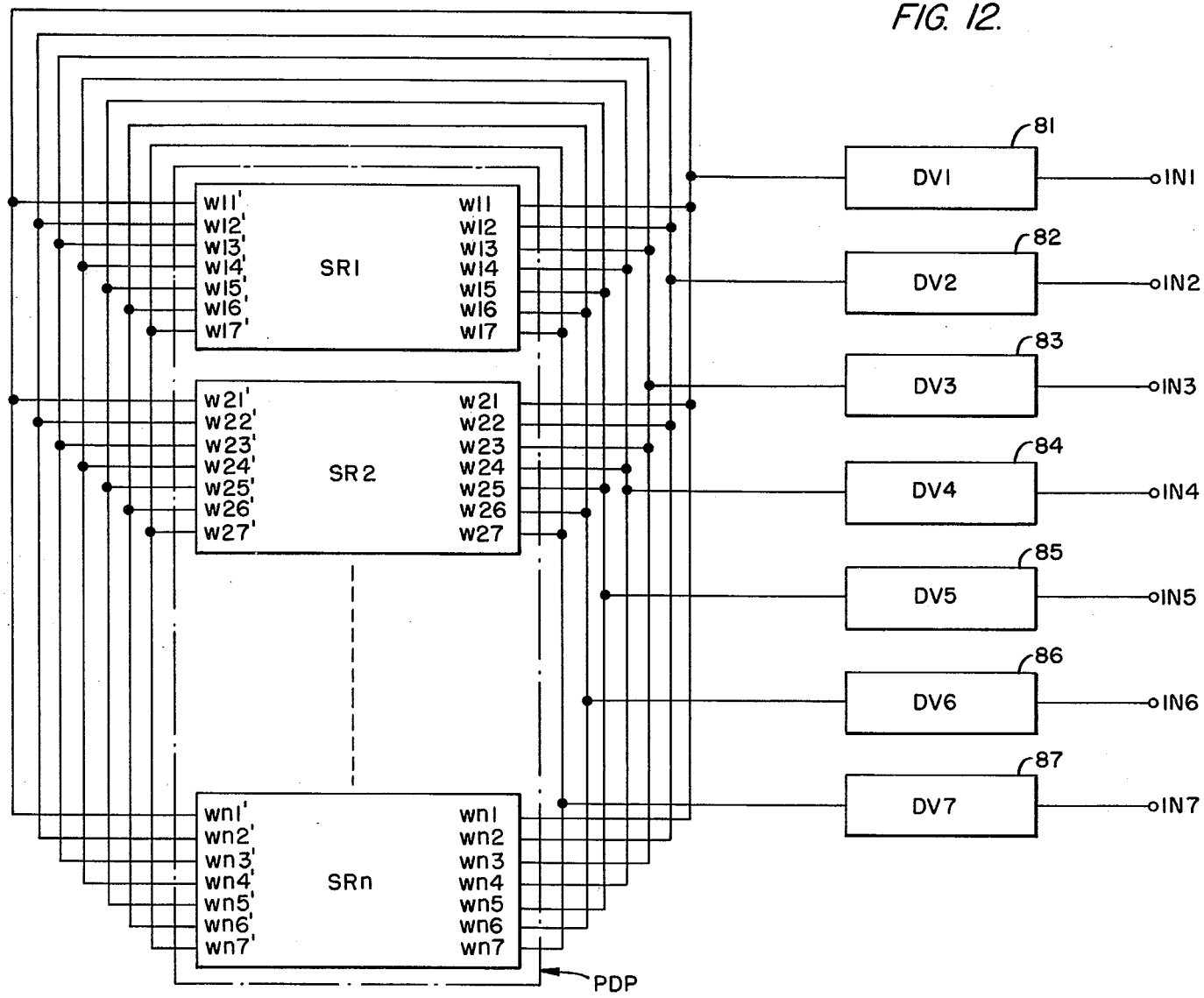
FIG. 12 shows another embodiment of the input data write-in system according to the present invention.

1. This invention can be applied when the shift row is composed of at least one shift channel and if there is more than one shift channel per shift row the selective driving can be made in common for all the shift channels of each shift row. On the other hand, each shift channel may be independently controlled.
2. It is not necessary that the number of steps in one period of the sway shift operation be equal to the number of steps in one period of the shift operation at the selected rows, or that the switching timing of either by equal, and the speed of the sway shift can be increased or decreased independently of the speed of the shift operation. Moreover, the sway shift operation can be realized within any desired spatial cell arrangement period, and there is no problem even when the number of cells does not coincide with the number of cell driving phases, and the discharge cells employed for the sway shift may even overlap with the cells in the adjacent period.
3. It is not always necessary that the unit time period of the shift operation be the same as for the sway shift operation and it is possible to change the period or the number of times of discharge within each step of each basic operation.
4. The operation of the shift row is the same whether the shift row is arranged in the lateral or longitudinal direction, and this invention can be adapted also to the panel which facilitates two dimensional shift along both lateral and longitudinal directions.
5. Entry of data into the shift channel may be performed from either or both ends of the shift rows and a written discharge spot can be shifted sequentially to the right or left direction as required. FIG. 12 shows an embodiment which facilitates such a write operation. According to this embodiment seven (7) write electrodes W11 to W17, ... Wn1, Wln, W2n, Wn7, W11' to W17', ... Wnl' to Wn7' are respectively provided at both sides of each of seven shift channels forming each shift row, and these write electrodes are connected mutually in common with the abovementioned seven write drivers 81 to 87. In this case the basic pulse trains are applied to the shift driver in a sequence that is different according to whether the selective shift operation is in the right or left direction.

As is clear from the above explanation, according to this invention, while the shift operation is performed at the selected rows in the self-shift type gas discharge panel for multi-row display, the data in the non-selected row is maintained in the form of discharge spots by means of the sway shift operation. Thus, the panel can be driven with sufficient operation margin and with a simple circuit configuration, and, moreover, during this period the data in the non-selected rows can be observed with sufficient brightness. What is more, when the sway shift operation is employed for all rows at the time of display, any difference in the brightness and any flickering generally accompanying transfer between operation modes can be eliminated, and thereby display quality can be improved. In addition, common write drivers can be used for the write electrode group in each shift row, which is very economical. Thus, the present invention has many advantages as the row selection and driving system of the self-shift type gas discharge panel for multi-row display.

We claim:

1. A system for driving a multi-row self shift type gas discharge panel for displaying information in the form of discharge spots, said panel having a plurality of shift rows, each of said shift rows comprising at least one shift channel, each said shift channel having a regular and periodic arrangement of discharge cells, said discharge cells being defined by a plurality of electrode groups, said system comprising:

means for selecting at least one of said shift rows;

means for applying shift operation voltages to the electrode groups defining the discharge cells of the shift channels of said selected shift rows(s) for shifting the discharge spots in said selected shift row(s) in a predetermined one of forward and backward directions; and means for applying sway operation voltages to the electrode groups defining the discharge cells of the shift channels of the non-selected one(s) of said plurality of shift rows for swaying the discharge spots in the shift channels of said non-selected shift rows within a predetermined number of adjacent discharge cells of said shift channels of said non-selected shift rows during said shift operation of discharge spots in said selected shift rows;

whereby the information in said selected shift row(s) is shifted while the information in said non-selected shift row(s) is displayed in predetermined locations by said sway operation.

2. The system of claim 1, wherein said predetermined number of adjacent discharge cells for said sway operation is equal to the number of discharge cells in one period of said periodic arrangement of discharge cells.

3. The system of claim 1, wherein each of said shift and sway operations comprises a respective basic cycle, and wherein each said basic cycle comprises a sequential series of unit pulse trains.

4. The system of claim 3, wherein the time duration of said basic cycle of said shift operation is equal to the time duration of said basic cycle of said sway operation.

5. The system of claim 3, wherein said basic cycles of said shift and sway operations have equal numbers of said unit pulse trains.

6. The system of claim 5, wherein said plurality of electrode groups comprise four groups and said basic cycles of said shift and sway operations each comprise four of said unit pulse trains.

7. The system of claim 6, wherein each of said unit pulse trains comprises a periodic rectangular wave of predetermined phase, the phases of two of said unit pulse trains are identical, and the phase of a third of said unit pulse trains is opposite in phase from said two unit pulse trains of identical phase.

8. The system of claim 7, wherein the phase of the fourth of said unit pulse trains is different from the phase of said two unit pulse trains having identical phase by an amount equal to the duration of an erase pulse for selectively erasing selected ones of said discharge spots, said erase pulse resulting from the superposition of said fourth unit pulse trains and one of said two pulse trains of identical phase.

9. The system of claim 1, further comprising means for writing information in the form of discharge spots into said shift rows, said writing means comprising write electrodes for defining write discharge cells adjacent to selected ones of said discharge cells of said shift channels of said shift rows.

10. The system of claim 9, wherein each of said write discharge cells comprises one electrode of said electrode groups, said one electrode being located at at least one end of each of said shift channels.

11. The system of claim 10, wherein said write electrodes are located so as to define one of said write discharge cells at each said end of each of said shift channels, and said write electrodes at both ends of each said shift channel are connected in common to each other.

12. The system of claims 10 or 11, wherein all of said write electrodes are connected in common.

13. A driving system for a multi-row self shift type gas discharge panel for displaying information in the form of discharge spots, said panel comprising two Y electrode groups arranged alternately to each other along each of a plurality of shift rows, two X electrode groups arranged alternately to each other and transversely to said Y electrode groups and separated from said Y electrode groups by a discharge space filled with ionizable gas, said X and Y electrode groups defining a regular arrangement of discharge cells, said arrangement of discharge cells defining a plurality of shift channels grouped into a plurality of said shift rows, said X electrode groups connecting in common corresponding electrodes of all said shift rows, said Y electrode groups connecting in common alternate respective electrodes of all the shift channels of each of said shift rows, and being lead out separately for each of said shift rows, said system comprising:

means for selecting at least one of said shift rows;

means for applying shift operation voltages to said X and Y electrode groups connected to the discharge cells of each of said selected shift rows for shifting the discharge spots in said selected shift rows in a predetermined one of forward and backward directions;

means for applying sway operation voltages to said X and Y electrode groups connected to the discharge cells of the non-selected ones of said shift rows for swaying the discharge spots in said non-selected shift rows during said shift operation in said selected shift rows, said sway operation comprising consecutive shifting of the respective discharge spots in forward and backward directions.

14. The system of claim 13, wherein said arrangement of discharge cells as connected to said groups of electrodes is periodic along said shift channels, and wherein said sway operation of each of said discharge spots in said non-selected shift channels occurs within one respective period of said periodic arrangement.

15. The system of claim 14, wherein each of said shift and sway operation voltages comprise a respective basic cycle, each said basic cycle comprises a sequential series of unit pulse trains, said pulse trains being arranged in respectively different sequences in each of said basic cycles.

16. The system of claim 15, wherein said unit pulse trains of said basic cycle applied to said two Y electrode groups of each of said selected shift rows are the same and applied at the same time as said unit pulse trains applied to said two Y electrode groups of each of said non-selected shift rows, for said unit pulse trains corresponding to said shift of the discharge spots in said non-selected shift rows in the same direction as said shift in said selected shift rows, and for the unit pulse train corresponding to the last shift in the opposite of said same direction during said sway operation.

17. The system of claim 16, wherein each said period of said periodic arrangement of discharge cells as connected to said groups of electrodes consist of four discharge cells, wherein said basic cycles comprise four unit pulse trains, and wherein said unit pulse trains applied to said two Y electrode groups of each of said selected shift rows are interchanged for said application at the same time to corresponding ones of said two Y electrode groups of each of said non-selected shift rows during the first shift in said opposite direction of said sway operation.

18. The system of claim 13, wherein said means for applying said shift and sway operation voltages comprise means for shifting and swaying pairs of said discharge spots in adjacent pairs of said discharge cells in said shift channels.

19. A system for driving a multi-row self shift type gas discharge panel for displaying information in the form of discharge spots, said panel comprising a plurality of shift rows, each said shift row comprising at least one shift channel, each said shift channel having a regular and periodic arrangement of discharge cells, said discharge cells being defined by a plurality of electrode groups, said system comprising:

means for selecting at least one of said shift rows;

means for applying shift operation voltages to said plurality of electrode groups for shifting the discharge spots of said selected shift rows in a selected one of forward and backward directions;

means for applying sway operation voltages to said electrode groups of said discharge cells of the non-selected ones of said shift rows for swaying the discharge spots in said non-selected shift rows during said shift operation in said selected shift rows; and means for subsequently applying, after said shift operation in said selected shift rows, said sway operation voltages to corresponding electrode groups of all said shift rows for swaying all said discharge points of said panel, said sway operation of each said discharge spot occurring within a respective one of the periodic discharge cell arrangement, whereby the information in said selected shift rows is changed while displaying the information in non-selected shift rows, and then all the information in the panel is displayed.

20. The system of claim 19, wherein the application of said sway operation voltages to said electrode groups of said non-selected shift rows is continued in regular sequence during the change from said shift operation to said sway operation in said selected shift rows.

21. A method for driving a multi-row self shift type gas discharge panel for displaying information in the form of discharge spots, said panel having a plurality of shift rows, each of said shift rows comprising at least one shift channel, each said shift channel having a regular and periodic arrangement of discharge cells, said discharge cells being defined by a plurality of electrode groups, said method comprising:

selecting at least one of said shift rows;

applying shift operation voltages to the electrode groups defining the discharge cells of the shift channels of said selected shift row(s) for shifting the discharge spots in said selected shift row(s) in a predetermined one of forward and backward directions; and applying sway operation voltages to the electrode groups defining the discharge cells of the shift channels of the non-selected one(s) of said plurality of shift rows for swaying the discharge spots in the shift channels of said non-selected shift rows within a predetermined number of adjacent discharge cells of said shift channels of said non-selected shift rows during said shift operation of discharge spots in said selected shift rows;

whereby the information in said selected shift row(s) is shifted while the information in said non-selected shift row(s) is displayed in predetermined locations by said sway operation.

22. The method of claim 21, further comprising writing information in the form of discharge spots into said shift rows by means comprising write electrodes for defining write discharge cells adjacent to selected ones of said discharge cells of of said shift channels of said shift rows.

23. A method for driving a multi-row self shift type gas discharge panel for displaying information in the form of discharge spots, said panel comprising a plurality of shift rows, each said shift row comprising at least one shift channel, each said shift channel having a regular and periodic arrangement of discharge cells, said discharge cells being defined by a plurality of electrode groups, said method comprising:

selecting at least one of said shift rows;

applying shift operation voltages to said plurality of electrode groups for shifting the discharge spots of said selected shift rows in a selected one of forward and backward directions;

applying sway operation voltages to said electrode groups of said discharge cells of the non-selected ones of said shift rows for swaying the discharge spots in said non-selected shift rows during said shift operation in said selected shift rows; and subsequently applying, after said shift operation in said selected shift rows, said sway operation voltages to corresponding electrode groups of all said shift rows for swaying all said discharge points of said panel, said sway operation of each said discharge spot occuring within a respective one of the periods of said periodic discharge cell arrangement, whereby the information in said selected shift rows is changed while the displaying the information in non-selected shift rows, and then all the information in the panel displayed.

* * * * *

UNITED STATES PATENT AND TRADEMARK OFFICE

CERTIFICATE OF CORRECTION

PATENT NO. : 4,190,789

DATED : February 26, 1980

INVENTOR(S) : TOYOSHI KAWADA ET AL.

It is certified that error appears in the above—identified patent and that said Letters Patent is hereby corrected as shown below:

Col. 1, line 52, "mis-firing" should be --misfiring--;

Col. 1, line 53, "transfering" should be --transferring--;

Col. 1, line 55, "transfering" should be --transferring--;

Col. 1, line 62, "eiminating" should be --eliminating--;

Col. 4, line 68, delete "cycle", after "of" insert --the--, and "period" should be --periods--;

Col. 7, line 56, "in" should be --In--;

Col. 13, line 6, after "Pat." insert --Serial--.

Signed and Sealed this

*Fifteenth* Day of *July 1980*

[SEAL]

*Attest:*

SIDNEY A. DIAMOND

*Attesting Officer*

*Commissioner of Patents and Trademarks*